US009010080B2

(12) United States Patent
Cazzola

(10) Patent No.: US 9,010,080 B2
(45) Date of Patent: Apr. 21, 2015

(54) ELASTIC CHAIN AND ORNAMENTAL ITEM MADE WITH SAID ELASTIC CHAIN

(71) Applicant: FOPE S.R.L., Vicenza (IT)

(72) Inventor: Umberto Cazzola, Vicenza (IT)

(73) Assignee: FOPE S.R.L., Vicenza (IT)

( * ) Notice: Subject to any disclaimer, the term of this patent is extended or adjusted under 35 U.S.C. 154(b) by 0 days.

(21) Appl. No.: 14/360,011

(22) PCT Filed: Dec. 14, 2012

(86) PCT No.: PCT/EP2012/075551

§ 371 (c)(1),
(2) Date: May 22, 2014

(87) PCT Pub. No.: WO2013/104487

PCT Pub. Date: Jul. 18, 2013

(65) Prior Publication Data

US 2014/0318101 A1 Oct. 30, 2014

(30) Foreign Application Priority Data

Jan. 11, 2012 (IT) ..... VI2012A00007

(51) Int. Cl.

| | |
|---|---|
| ***A44C 5/04*** | (2006.01) |
| ***A44C 5/00*** | (2006.01) |
| ***A44C 5/08*** | (2006.01) |
| ***A44C 11/00*** | (2006.01) |

(52) U.S. Cl.

CPC ..... *A44C 5/04* (2013.01); *A44C 5/0061* (2013.01); *A44C 5/08* (2013.01); *A44C 11/00* (2013.01)

(58) Field of Classification Search

CPC ..... A44C 5/04; A44C 5/08; A44C 11/08; A44C 5/0061

USPC ..... 59/79.1, 79.2, 79.3

See application file for complete search history.

(56) References Cited

U.S. PATENT DOCUMENTS 787,639 A * 4/1905 Rioux ..... 59/79.3
843,188 A * 2/1907 Wilde ..... 59/79.3

(Continued)

FOREIGN PATENT DOCUMENTS

DE 1 151 690 B 7/1963
DE 12 44 456 B 7/1967

(Continued)

OTHER PUBLICATIONS

International Search Report and Written Opinion dated Feb. 15, 2013, issued in PCT Application No. PCT/EP2012/075551, filed Dec. 14, 2012.

*Primary Examiner* — David B Jones
(74) *Attorney, Agent, or Firm* — Workman Nydegger

(57) ABSTRACT

An extensible chain includes a plurality of cage-shaped elements (2) connected to one another in succession, each one of which includes a flat central body (3) from which two or more lateral arms (4) branch off whose free ends are slidingly inserted in an adjacent cage-shaped element. The adjacent elements define an intermediate space in which there is a spring (6) obtained from a plane metal sheet element from which two tabs (**6*b*) depart that are opposite each other with respect to the base of the metal sheet element and are positioned above it at a distance (H) that, when the spring is at rest, exceeds the distance between the free ends of the lateral arms (4) of any cage-shaped element and the central body (3**) of the adjacent cage-shaped element.

12 Claims, 3 Drawing Sheets

(56) References Cited

U.S. PATENT DOCUMENTS

| | | | | | |
|---|---|---|---|---|---|
| 1,645,394 | A | * | 10/1927 | Newman | 59/79.3 |
| 1,676,706 | A | * | 7/1928 | Payette | 59/79.3 |
| 2,513,288 | A | * | 7/1950 | Cowan | 59/79.3 |
| 2,573,415 | A | * | 10/1951 | Ebert | 59/79.3 |
| 2,805,541 | A | * | 9/1957 | Vastano | 59/79.1 |
| 3,332,592 | A | * | 7/1967 | Burkle | 224/175 |
| 3,453,821 | A | * | 7/1969 | Kian | 59/79.3 |
| 4,999,990 | A | * | 3/1991 | Wong | 59/79.1 |
| 6,978,596 | B1 | * | 12/2005 | Lee | 59/79.3 |
| 7,506,495 | B2 | * | 3/2009 | Cazzola | 59/79.1 |

FOREIGN PATENT DOCUMENTS

| | | |
|---|---|---|
| EP | 1 943 916 B1 | 2/2010 |
| WO | 2009/039893 A1 | 4/2009 |

* cited by examiner

ELASTIC CHAIN AND ORNAMENTAL ITEM MADE WITH SAID ELASTIC CHAIN

BACKGROUND OF THE INVENTION

1. Field of the Invention

The present invention concerns an extensible chain particularly suitable for making an ornamental item to be worn, like for example a bracelet, a necklace or similar objects.

The present invention also concerns an ornamental item comprising the above mentioned extensible chain.

2. Present State of the Art

As is known, there are various types of necklaces, bracelets and other analogous ornamental objects comprising a plurality of elements connected to one another in succession to form a chain.

According to one of said known embodiments, the chain comprises a plurality of cage-shaped elements connected in succession, each one of which is constituted by a central body from which two or more lateral bodies branch off whose free ends face the corresponding central body and are arranged opposite each other and inserted in an adjacent cage-shaped element.

The lateral bodies delimit the cage-shaped element laterally and are spaced from each other in such a way as to define slits that slidingly house the free ends of an adjacent cage-shaped element.

The chain described above is deformable and extensible in such a way as to adapt to the wrist, neck or even finger (in the case of a ring) of the person who wears it, since each cage-shaped element can slide in the adjacent cage-shaped element and can also assume various inclinations with respect to it.

Said chain is particularly simple to construct, since it comprises a single type of modular element that can be connected to other analogous elements in any number in order to make chains having various lengths.

An example of a chain made according to the technique explained above is described in the European Patent EP 1 943 916 B1, in the name of the same applicant that is filing the present invention.

The chain just mentioned above comprises cage-shaped elements, each one of which has its two ends that penetrate the ends of corresponding adjacent elements.

In this way, the ends of two adjacent elements delimit an intermediate space in which a cylindrical spring is interposed.

As the elements are arranged in such a way as to penetrate each other, when the chain is stretched the ends of the elements of each pair move near each other and compress the springs.

When the chain is released, the elastic reaction generated by the springs tends to make the chain return to the rest position.

Notwithstanding the advantages deriving from the above mentioned elasticity, the maximum stretching is limited by the length of the springs in the configuration of maximum compression, substantially corresponding to the number of turns multiplied by the thickness of the material of which they are made.

For the purpose of increasing the elasticity of the chain, that is, of increasing the difference in length between the rest position and the maximum extension of the chain, the Patent application VI2009A000236 describes the use of a spring that is not cylindrical any longer but in the shape of a truncated cone, so that during the compression stage the turns are arranged on the same plane and thus the overall dimensions of the compressed spring correspond to the diameter of a turn.

This solution, which seemed to be suited to solve the problem of increasing the elasticity of the chain, has proven to be unfeasible due both to the high cost of the equipment necessary to make a truncated cone-shaped spring with the reduced dimensions typical of the springs used in jewellery and to the fact that the presence of the helical shape leads to problems related to the need to center the spring with respect to the elements between which it is included and to keep it in position while the chain is being used by the users.

SUMMARY OF THE INVENTION

The object of the present invention is to overcome the drawbacks mentioned above.

In particular, it is a first object of the invention to provide an extensible chain with increased extension capacity compared to a chain of the known type and to the chains that use spiral springs.

Another object of the invention is to provide a spring different from the springs of the spiral type, in order to simplify its construction.

It is another object of the invention to minimise the problems related to the centering of the spring in the space where it is inserted.

The objects mentioned above are achieved by an extensible chain constructed according to the main claim.

Further characteristics and details of the chain that is the subject of the invention are described in the corresponding dependent claims.

The object of the invention is also achieved by an ornamental item to be worn, constructed according to claim 7).

Advantageously, the increased extensibility of the chain of the invention, deriving from the fact that the wire making up the spiral spring has been replaced with a spring made starting from a very thin metal sheet, makes it possible to provide ornamental objects that, compared to analogous ornamental objects of the known type, adapt to a higher number of sizes.

Furthermore, the construction of the spring according to the invention is particularly simplified compared to the spiral springs made according to the patent documents mentioned above.

BRIEF DESCRIPTION OF THE DRAWINGS

The objects and advantages described above are highlighted in greater detail during the description of a preferred embodiment of the invention that is provided by way of example without limitation with reference to the attached drawings, wherein.

DETAILED DESCRIPTION OF THE PREFERRED EMBODIMENTS

Figure 1:
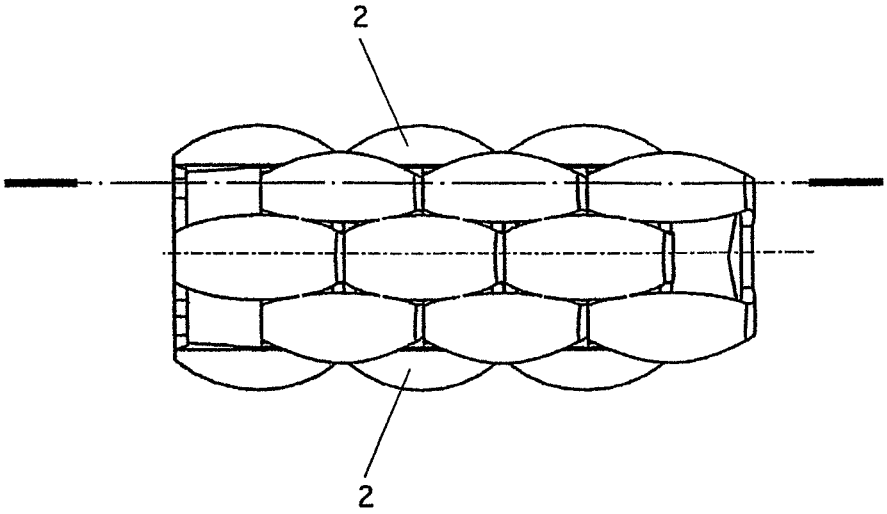
FIG. 1 shows an axonometric view of a portion of the chain of the invention.
Figure 6:
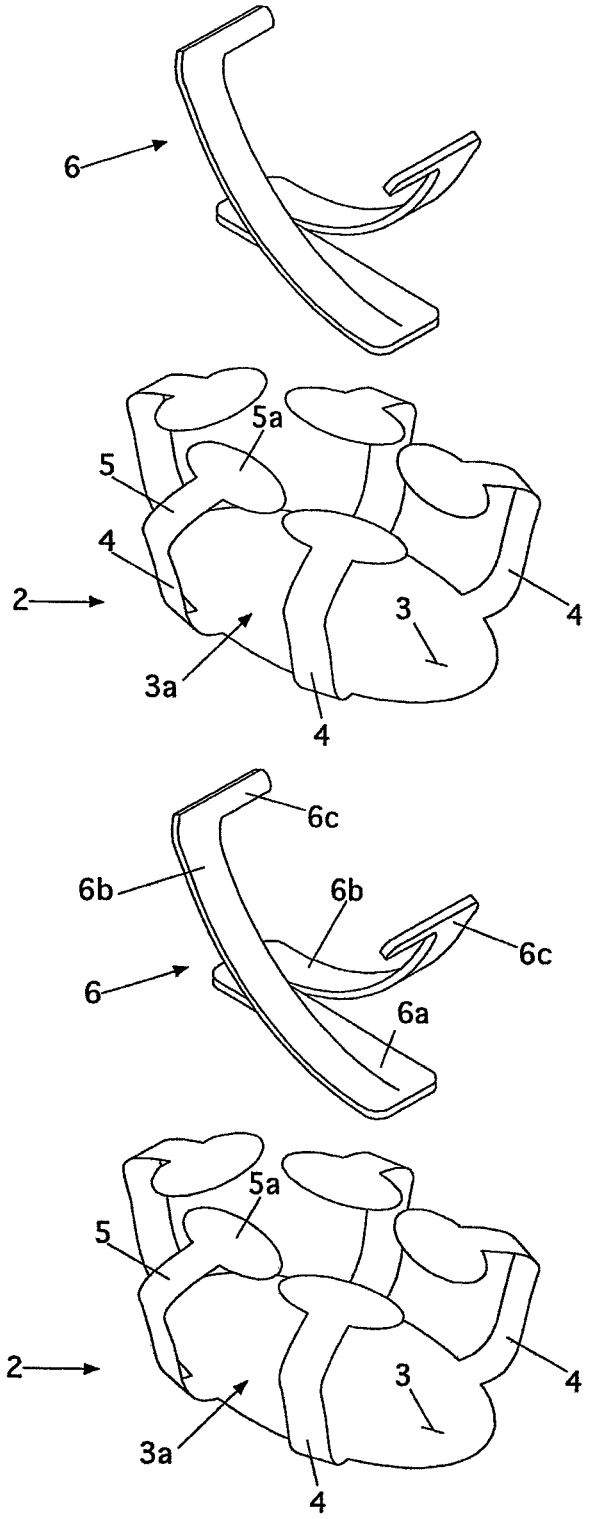
FIG. 6 shows an axonometric view of two elements of the chain with a spring interposed therebetween before their assembly.

With reference to FIG. 1, which shows a portion of the chain of the invention, indicated as a whole by 1, it can be observed that it comprises a plurality of cage-shaped elements 2 connected in succession and visible also in the axonometric view shown in FIG. 6.

Always making reference to FIG. 6 for the sake of clarity, it can be observed that each one of the cage-shaped elements 2 comprises a central body 3 from which more than one lateral arms 4 branch off whose free ends 5 are bent towards the base and terminate with an enlarged portion 5*a*.

Each lateral arm 4 is slidingly inserted in another cage-shaped element 2 adjacent to the first cage-shaped element 2.

When the chain is completed and is in the condition of maximum extension, the free ends 5 of each cage-shaped element 2 rest on the surface of the central body 3.

According to the example of embodiment shown in FIG. 6, the central body is elliptical in shape, but there is nothing against said central body being also circular or having any other shape.

Always with reference to FIG. 6, it can be noticed that the enlarged portion 5*a* of the free end 5 advantageously prevents it from coming out of the corresponding slit 3*a* that appears as an empty space between two lateral arms 4, thus avoiding the accidental opening of the cage-shaped element 2 and the consequent interruption of the chain.

As already underlined, the enlarged portions 5*a* of the free ends 5 of the lateral arms of each cage-shaped element can slide along the slits defined by the adjacent element and specifically by two lateral arms positioned side by side.

In order to maintain the elements of the chain in the rest position near one another and at the same time achieve a condition in which when the cage-shaped elements are moved away from each other they elastically return to the rest position, a spring 6 is interposed between a cage-shaped element and the other. The spring 6, according to the invention and as shown in FIG. 3, is made starting from a plane metal sheet element in a material that is an alloy mainly made of a precious metal like gold, even 18 k or 24 k gold, and other chemical compounds suited to give this alloy the maximum possible elasticity, as is known, on the other hand, to the persons skilled in the art.

By way of non-limiting example, it can be observed that the metal sheet element used to make the spring 6 of the example of embodiment being described has a thickness of 0.22 mm.

Figure 3:
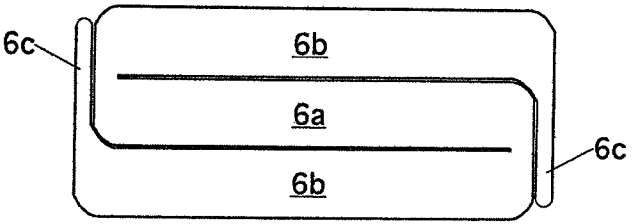
FIG. 3 shows a top view of the spring of the chain of the invention.

By means of a normal technology, for example using shearing dies, the metal sheet element is cut out following the pattern visible in FIG. 3, in such a way as to define an elongated base portion 6*a* and two tabs 6*b* opposite each other with respect to the base and substantially having the shape of an L as they terminate with a short portion 6*c* arranged in a substantially orthogonal position with respect to the long portion of the tab 6*b*.

Figure 4:
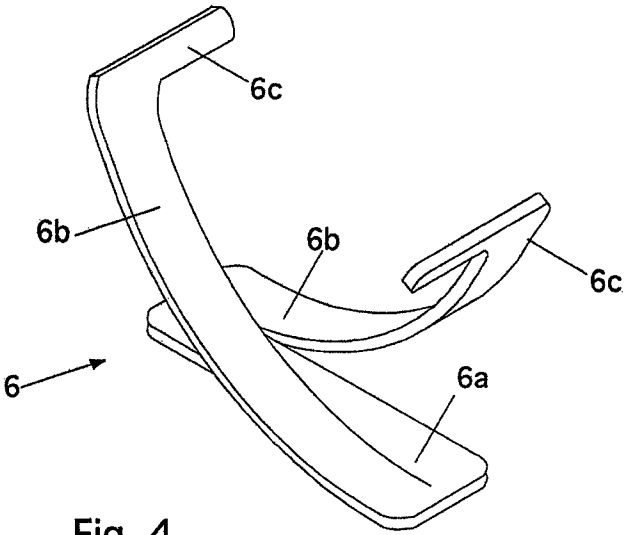
FIG. 4 shows the spring of FIG. 3 in its normal rest position.

As shown in FIG. 4, after the cutting operation the tabs 6*b* are raised, for example following the action of apposite punches that produce a plastic deformation, until the terminal portions 6*c* come to lie on a plane parallel to the plane containing the base 6*a*, and are arranged at such a distance H from the base that the maximum overall dimensions of the spring 6 slightly exceed the maximum space that is created between the central body 3 of a cage-shaped element and the enlarged portions 5*a* of the free ends 5 of a cage-shaped element that precedes the element in question and fits in the space present between two consecutive lateral arms of the same cage-shaped element.

Figure 2:
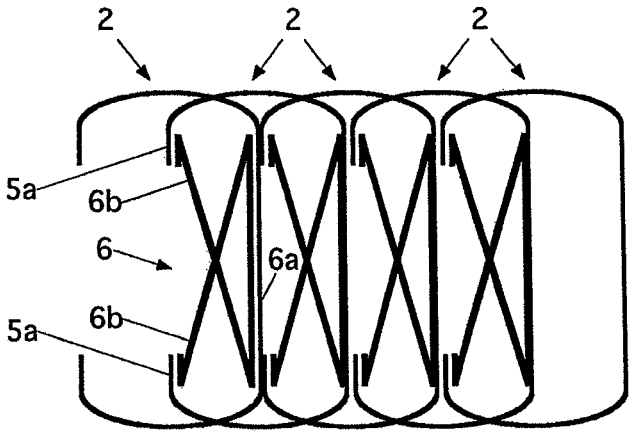
FIG. 2 shows a schematic view of the position of the springs with respect to the cage-shaped elements of the chain portion shown in FIG. 1.
Figure 4A:
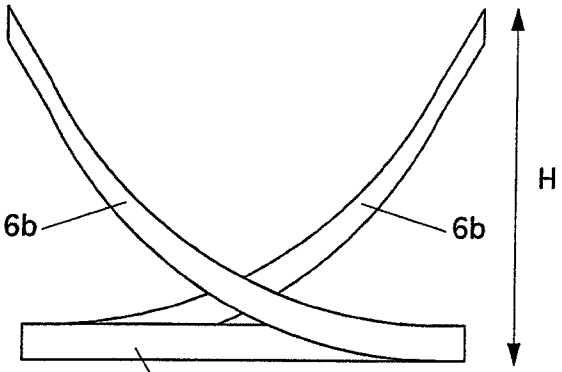
FIG. 4*a* shows a front view of the spring shown in FIG. 4.
Figure 5:
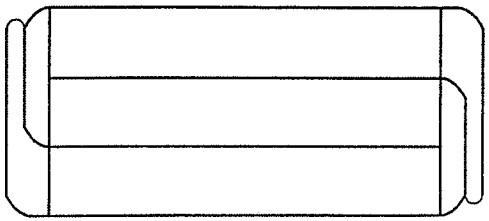
FIG. 5 shows a top view of the spring shown in FIG. 4.

It should be noticed that the spring 6 operates in optimal conditions since, as shown in FIG. 2, when it is at rest the base 6*a* lies on the supporting surface of the cage-shaped element 2 while the free ends 6*c* of the opposite tabs of the spring 6 rest on the enlarged portions 5*a* of the bent free ends 5 of the cage-shaped element that precedes the cage-shaped element housing the base of the spring.

It can be easily understood that in this condition the chain can be extended until the tabs 6*b* and the external portions 6*c* of the spring 6 return to lie on the same plane as the base portion 6*a*, that is, until the spring assumes the plane position again, meaning a configuration like the initial configuration of the metal sheet element from which it has been obtained.

In the case illustrated in the example, it has been said that the metal sheet element used to make the spring has a thickness of 0.22 mm.

In this way the cage-shaped elements of the chain can be extended over the entire length of the slits of the lateral arms less the thickness of the metal sheet element generating the spring, that is, less 0.22 mm.

The maximum possible extensibility is thus obtained, together with optimal elastic return guaranteed by the elastic nature of the material used to make the spring, which maintains its elasticity even after being subjected to the plastic deformation produced to raise the tabs 6*b* at the desired height.

In a variant embodiment of the invention, the spring illustrated in FIG. 6 with plane, substantially rectangular development can have a plane development with a different geometric shape, for example a square shape or any other shape, with no consequences for its operation.

Regarding the cage-shaped elements 2, these are preferably made of metal sheet and in particular of a precious metal sheet; nonetheless they can also be made of a different material, provided that they are deformable so as to allow the assembly of the chain 1.

In practice, and according to what is shown in FIG. 2, when the chain 1 is stretched, the cage-shaped elements 2 move away from each other and the free ends 5 of each of them slide in the slits 3*a* created by the spaced lateral arms of each cage-shaped element.

The corresponding spring 6 is compressed and reacts with an elastic return action in the chain contraction direction.

It is clear that a chain of the type described above can be used to make an ornamental item like a bracelet or a necklace, or even a ring.

It can also be understood that the considerable elasticity of the chain 1 makes it possible to produce ornamental items that are closed to form a ring and therefore without opening and closing devices (in the technical jargon of jewellery called "closures"), to the advantage of aesthetical appearance, ease of production and ease of use.

Finally, it is equally important to observe that the possible absence of a closure for the necklaces or bracelets made with the chain of the invention makes it possible to minimise the risk that the closure may inadvertently be opened and the ornamental item, even precious, be lost.

Furthermore, it is important to underline also that the invention achieves the object to provide an entirely modular elastic chain by using springs, each one of which is associated with a corresponding cage-shaped element and is independent of the other springs.

In the construction stage, further changes or construction variants of the chain that is the subject of the invention—that are neither described herein nor represented in the drawings—may be carried out.

Said changes or variants must all be considered protected by the present patent, provided that they fall within the scope of the claims expressed below.

In the cases where the technical characteristics illustrated in the claims are followed by reference signs, these have been added only with the aim to facilitate the comprehension of the claims themselves, and therefore said reference signs do not have any limiting effect on the degree of protection to be granted to each element they identify by way of example.

The invention claimed is:

1. An extensible chain comprising:

a plurality of cage-shaped elements connected to one another in succession, each one of said cage-shaped elements comprising:

a substantially flat central body; and two or more lateral arms extending from the central body, each lateral arm comprising a free end oriented so as to face the central body, and each free end being slidingly inserted in an adjacent cage-shaped element;

wherein a given cage-shaped element is oriented with respect to an adjacent cage-shaped element so as to define an intermediate space between the free ends of the lateral arms of the given cage-shaped element and the central body of the adjacent cage-shaped element; and a spring positioned in the intermediate space and configured to compress as the given cage-shaped element and the adjacent cage-shaped element are moved relative to one another to contract the intermediate space;

wherein said spring is formed from flat metal sheeting and comprises a base and two tabs disposed on opposite sides of the base, the two tabs projecting a distance above the base that, when said spring is at rest outside of the intermediate space, exceeds the distance between said free ends of said lateral arms of the given cage-shaped element and the central body of the adjacent cage-shaped element.

2. The chain according to claim 1, wherein each one of the two tabs of said spring is substantially L-shaped, the substantially L-shaped tabs comprising a short portion and a long portion, each long portion extending from a first end at the base to a second end, and each short portion being disposed at the second end.

3. The chain according to claim 1, wherein the base of said spring is arranged so that it rests on and is in contact with a surface of said central body of the adjacent cage-shaped element.

4. The chain according to claim 1, wherein the spring is flat in a fully compressed configuration, the spring having a thickness that is equal to the thickness of the flat metal sheeting.

5. The chain according to claim 1, wherein said flat metal sheeting has a thickness that does not exceed 0.22 mm.

6. The chain according to claim 1, wherein said flat metal sheeting is made of a gold alloy with at least 18 Kt.

7. An ornamental item suited to be worn, the ornamental item comprising an extensible chain, the extensible chain comprising:

a plurality of cage-shaped elements connected to one another in succession, each one of said cage-shaped elements comprising:

a substantially flat central body; and two or more lateral arms extending from the central body, each lateral arm comprising a free end oriented so as to face the central body, and each free end being slidingly inserted in an adjacent cage-shaped element;

wherein a given cage-shaped element is oriented with respect to an adjacent cage-shaped element so as to define an intermediate space between the free ends of the lateral arms of the given cage-shaped element and the central body of the adjacent cage-shaped element; and a spring positioned in the intermediate space and configured to compress as the given cage-shaped element and the adjacent cage-shaped element are moved relative to one another to contract the intermediate space;

wherein said spring is formed from flat metal sheeting and comprises a base and two tabs disposed on opposite sides of the base, the two tabs projecting a distance above the base that, when said spring is at rest outside of the intermediate space, exceeds the distance between said free ends of said lateral arms of the given cage-shaped element and the central body of the adjacent cage-shaped element.

8. The ornamental item suited to be worn according to claim 7, wherein the ornamental item is a necklace.

9. The ornamental item according to claim 8, wherein said necklace is without a closure.

10. The ornamental item suited to be worn according to claim 7, wherein the ornamental item is a bracelet.

11. The ornamental item suited to be worn according to claim 10, wherein said bracelet is without a closure.

12. An extensible chain comprising:

a plurality of cage-shaped elements connected to one another in succession, each one of the cage-shaped elements comprising:

a substantially flat central body; and two or more lateral arms extending from the central body, each lateral arm comprising a free end oriented so as to face toward the central body, and each free end being inserted in an adjacent cage-shaped element;

wherein a given cage-shaped element is oriented with respect to an adjacent cage-shaped element so as to define an intermediate space between the free ends of the lateral arms of the given cage-shaped element and the central body of the adjacent cage-shaped element; and a spring positioned in the intermediate space and configured to compress as the given cage-shaped element and the adjacent cage-shaped element are moved relative to one another to contract the intermediate space;

wherein the spring is formed from flat metal sheeting and comprises a base and two tabs disposed on opposite sides of the base, the two tabs projecting a distance above the base so that the spring resiliently biases against the free ends of the lateral arms of the given cage-shaped element and the central body of the adjacent cage-shaped element.

* * * * *